US008171835B2

(12) United States Patent
Otsuka

(10) Patent No.: US 8,171,835 B2
(45) Date of Patent: May 8, 2012

(54) APPARATUS FOR CHAMFERING FOLD FORMATION TAPE ENDS

(75) Inventor: Joji Otsuka, Daito (JP)

(73) Assignee: Daiso Co., Ltd., Daito-shi (JP)

( * ) Notice: Subject to any disclaimer, the term of this patent is extended or adjusted under 35 U.S.C. 154(b) by 484 days.

(21) Appl. No.: 12/446,314

(22) PCT Filed: Oct. 29, 2007

(86) PCT No.: PCT/JP2007/071047

§ 371 (c)(1),
(2), (4) Date: Apr. 20, 2009

(87) PCT Pub. No.: WO2008/120414

PCT Pub. Date: Oct. 9, 2008

(65) Prior Publication Data

US 2010/0319512 A1 Dec. 23, 2010

(30) Foreign Application Priority Data

Mar. 29, 2007 (JP) ..... 2007-088472

(51) Int. Cl.
*B26D 5/18* (2006.01)

(52) U.S. Cl. ..... 83/581; 83/618; 83/951

(58) Field of Classification Search ..... 83/578, 83/375, 379, 384, 385–389, 618, 619, 628, 83/697, 951, 581, 391–393, 52
See application file for complete search history.

(56) References Cited

U.S. PATENT DOCUMENTS 228,795 A * 6/1880 Withey ..... 83/266
2,828,495 A * 4/1958 Sjoberg ..... 12/20
(Continued)

FOREIGN PATENT DOCUMENTS

JP 48-51389 7/1973
(Continued)

OTHER PUBLICATIONS

International Search Report for International Application No. PCT/JP2007/071047 dated Jan. 7, 2008.

*Primary Examiner* — Sean Michalski
(74) *Attorney, Agent, or Firm* — Kratz, Quintos & Hanson, LLP

(57) ABSTRACT

[Object] An apparatus for chamfering fold formation tape ends is provided which not only facilitates setting of a workpiece tape but also simultaneously carries out cutting of the tape so as to form acute-angled ends and chamfering of the side faces of the tape ends to perform end processing at two positions at a time.

[Means for Solving the Problems] The apparatus for chamfering fold formation tape ends includes: a positioning stopper 48 for restricting the position of one end of a workpiece tape on a platform 2; a vertically-movable engagement rod 10 for applying an arresting force onto the workpiece tape from above while one end of the workpiece tape being received by the positioning stopper 48; a pair of form cutters 21 arranged opposite to each other with an engagement needle 11 provided at the leading end of the engagement rod 10 positioned intermediate therebetween and aligned in an axial direction of the workpiece tape, for obliquely cutting into the workpiece tape from above so as to form acute-angled ends and chamfering the workpiece tape; a driving means 30 for advancing and retracting the pair of cutters 21 in conjunction with a vertical movement of the engagement rod 10; and a control lever 41 for operating the driving means 30.

8 Claims, 11 Drawing Sheets

U.S. PATENT DOCUMENTS

| | | | | | |
|---|---|---|---|---|---|
| 3,077,805 | A | * | 2/1963 | Stanley | 83/384 |
| 3,413,881 | A | * | 12/1968 | Stolzer | 83/486 |
| 3,949,631 | A | * | 4/1976 | Goldman et al. | 83/98 |
| 4,589,314 | A | * | 5/1986 | Ralph et al. | 83/144 |
| 4,781,093 | A | * | 11/1988 | Guenard | 83/176 |
| 4,909,110 | A | * | 3/1990 | Borzym | 83/319 |
| 5,603,253 | A | * | 2/1997 | Logan | 83/875 |
| 5,746,102 | A | * | 5/1998 | Benzing et al. | 83/34 |
| 6,170,478 | B1 | * | 1/2001 | Gorder | 125/12 |
| 7,823,490 | B2 | * | 11/2010 | Evans et al. | 83/39 |

FOREIGN PATENT DOCUMENTS

| | | | |
|---|---|---|---|
| JP | 60-221292 | | 11/1985 |
| JP | 63-107591 | | 7/1988 |
| JP | 5-293792 | | 11/1993 |
| JP | 9-253932 | | 9/1997 |
| JP | 11-221794 | | 8/1999 |
| JP | 11-333784 | | 12/1999 |
| JP | 2000-135746 | | 5/2000 |
| JP | 2001-138282 | A1 | 5/2001 |
| JP | 2001-301066 | A1 | 10/2001 |
| JP | 2002-307376 | A1 | 10/2002 |
| JP | 2003-165166 | A1 | 6/2003 |
| JP | 2004-17232 | A1 | 1/2004 |
| JP | 2004-177128 | A1 | 6/2004 |
| JP | 2004-330315 | A1 | 11/2004 |
| JP | 2005-193523 | A1 | 7/2005 |

* cited by examiner

4(a)

4(b)

APPARATUS FOR CHAMFERING FOLD FORMATION TAPE ENDS

TECHNICAL FIELD

The present invention relates to an apparatus for chamfering fold formation tape ends. The apparatus cuts the ends of a fold formation tape so as to form inclined faces, which fold formation tape is used for forming a fold in a packing box blank in the process of forming the blank from e.g., paperboard or corrugated board.

BACKGROUND ART

Previously, when producing a packing box from paperboard or corrugated board, paperboard or corrugated board is cut into a desired shape with a punch die to form a blank. In the process of blanking a packing box, a cutting blade 103 and a fold pressure-engraving member 104 for forming a fold without use of a cutting edge are attached to an upper die 101 of a punch die 100 as shown in FIG. 9 in order to blank a desired shape from a sheet material while forming a fold or kerf in the blank. Affixed to a lower die 102 opposed to the upper die 101 is a fold formation tape 110 which is made of fiber and provided at a position corresponding to the fold pressure-engraving member 104 in order to engrave a fold with pressure.

As illustrated in FIG. 11, in the fold formation tape 110, a fold formation groove 111 is defined by two flat groove formation members 112 which are opposed to each other with a specified spacing and each of which has an inclined face at one side thereof. In this fold formation tape 110, the rear faces of the groove formation members 112 are each provided with a pressure-sensitive adhesive layer 114 the surface of which is covered with release coated paper 113. Before use of the fold formation tape 110, an attachment aid strip 115 is temporarily fit to the fold formation groove 111. The attachment aid strip 115 has a setting groove 116 that helps attachment of the fold formation tape 110 to the board face of the lower die 102 by use of the fold pressure-engraving member 104. Generally, the fold pressure-engraving member 104 provided in the upper die 101 of the punch die 100 is fitted into the setting groove 116 to thereby retain the fold formation tape 110 with the upper die 101 (as indicated by dashed two dotted line in FIG. 9). Then, the release coated paper 113 is peeled off the rear face of the fold formation tape 110 to expose the pressure-sensitive adhesive layer 114 and, in this condition, the fold formation tape 110 is pressed against the board face of the lower die 102 and affixed thereto. In the process of punching a sheet material, the fold pressure-engraving member 104 becomes registered with the center line of the fold formation groove 111 of the fold formation tape 110 so that accurate pressure engraving of a fold becomes possible. After the fold formation tape 110 is fixedly placed in a correct position on the board face of the lower die 102, the attachment aid strip 115 that allows the fold pressure-engraving member 104 to temporarily retain the fold formation tape 110 is detached together with a bond tape 117. Thereafter, the fold formation groove 111 on the board face of the lower die 102 appears.

Generally, in the case of a packing box formed by punching, there are many places where folds intersect (i.e., fold intersection areas), depending on the shape of the blank. In this case, the fold formation tapes 110 are affixed to the board face of the lower die so as not to overlap each other in the fold intersection areas. Specifically, an end 110*a* of each fold formation tape 110 is obliquely cut so as to make a sharp-pointed end as shown in FIG. 10 and the fold formation tapes

110 are affixed to the board face with their sharp-pointed ends in butting contact with each other. If the cut fold formation tapes 110 are used as they are in the fold intersection areas, the edges of the cut end will vertically project, thrusting into the surfaces of the blank when a fold is formed and, as a result, the blank surfaces will be hurt. To avoid this, post treatment (chamfering) is applied to the fold formation tapes to obliquely cut down the angular side edges 118 to thereby remove the projecting points.

Such chamfering treatment has heretofore been manually carried out by use of a cutter knife or the like. However, the manual processing of a large number of fold formation tapes requires a lot of labor and therefore is inefficient. Recently, there have been proposed chamfering techniques that utilize a machine and some of them have come into practical use (see Patent Documents 1 to 3).

Patent Document 1: JP-A-2000-135746

Patent Document 2: JP-A-2003-165166

Patent Document 3: JP-A-2005-193523

In the technique disclosed in Patent Document 1, a workpiece material to be chamfered (that is referred to as "supported grooved member" in the specification) is placed on a member supporting table such that it can be compressed from above and below. An end of the workpiece material is tilted at a specified angle relative to a rotary cutter and the side faces of one end are cut one by one, thereby chamfering the workpiece material. This technique has accordingly revealed the disadvantage that the workpiece material has to change its position at least twice for chamfer processing, which takes a lot of time and labor. In addition, the length of the workpiece material to be used must be determined in accordance with its use position and therefore the workpiece material cut into a specified length needs to be chamfered at both ends. That is, the workpiece material has to be turned around and chamfered twice at each end. And, the angle of the workpiece material has to be adjusted whenever the position of the workpiece is changed. Such a chamfering process leads to poor operational efficiency. Moreover, the apparatus for carrying out such a process is complicated in structure and difficult to handle.

The apparatus disclosed in Patent Document 2 is designed to individually cut the ends of a fold formation member (workpiece material) by use of two cutting devices. After the fold formation member is fixedly placed on a fixing table, the fixing table is rotated through a specified angle in a direction toward the cutting devices located at a side of the fixing table and then fixed. Thereafter, the associated cutting device is operated to cut one end of the fold formation member with a cutting blade. Accordingly, the fixing table on which the fold formation member is mounted is required to be turned around twice in this apparatus. Such turning operation sounds simple but is actually troublesome. In addition, the ends of the fold formation member are processed one by one so that the apparatus of Patent Document 2 exhibits poor workability similarly to Patent Document 1.

Patent Document 3 discloses a ruled line formation tape end cutting apparatus configured to chamfer both side faces of the ends of a workpiece tape placed on a support table by centering with a pair of rotary cutters having a hat-shaped cutter face. The workpiece tape is preliminarily cut such that its ends have an acute angle. Since the apparatus of the above structure carries out chamfer finishing by cutting both sides of the ends of a workpiece tape, which has been cut to have acute-angled ends, at a time with the rotary cutters, it seems to be more efficient compared to the prior art techniques described earlier. However, this apparatus poses a security risk because the rotating cutters come in proximity to the operator's hands when setting a workpiece tape in the processing section. If the rotation of the cutters is stopped each time a workpiece tape is set, the workability of the apparatus will decrease. Therefore, the operator is required to set a workpiece while continuing the operation of the apparatus. This setting operation is performed in a narrow space and therefore highly risky.

DISCLOSURE OF THE INVENTION

Problems that the Invention Intends to Solve

The invention is directed to overcoming the problems described above and therefore a primary object of the invention is to provide an apparatus for chamfering fold formation tape ends, which apparatus is capable of not only facilitating setting of a workpiece tape, but also simultaneously carrying out cutting of the tape so as to form acute-angled ends and chamfering of the side faces of the tape ends to perform end processing at two positions at a time.

Means for Solving the Problems

In accomplishing the above object, the invention provides an apparatus for chamfering fold formation tape ends, the apparatus comprising:

a restricting member for restricting the position of one end of a workpiece tape on a platform;

a vertically-movable arresting force applying member for applying an arresting force onto the workpiece tape from above while one end of the workpiece tape being received by the restricting member;

a pair of form cutters arranged opposite to each other with the arresting force applying member positioned intermediate therebetween and aligned in an axial direction of the workpiece tape, for obliquely cutting into the workpiece tape from above so as to form acute-angled ends and chamfering the workpiece tape;

driving means for advancing and retracting the pair of cutters in relation to the workpiece tape in conjunction with a vertical movement of the arresting force applying member; and an operating section for operating the driving means.

In the invention, the arresting force applying member preferably comprises an engagement rod that is vertically movable relative to the workpiece tape fixedly placed on the platform and an engagement needle provided at the leading end of the engagement rod such that it can pass through a center line of the workpiece tape to hold the workpiece tape.

Preferably, the pair of cutters are inclined downward and supported, at their respective shanks, by brackets standing upright at side positions of the platform respectively, such that the cutters can be synchronously advanced and retracted relative to the workpiece tape.

Preferably, the driving means includes a slider that is vertically movable along a frame mounted on the platform and a pair of pivotable cams connected to driving rods respectively, and cutter operating pins attached to the cams are brought into engagement with cutter operation holes, respectively, provided in the cutters, thereby driving the cutters.

The operating section may be a manually-operable operating lever for applying a press down force to the slider, or alternatively a hydraulic cylinder or pneumatic cylinder for applying a press down force to the slider.

In the invention, magnet pieces may be embedded in the peripheral faces of the cams respectively to absorptively retain the leading ends of the cutters. Alternatively, the frame has guide pins that are projectingly provided at positions facing the lower faces of the leading ends of the cams respectively to retain the leading ends of the cutters.

Effects of The Invention

In the invention, after the workpiece is mounted on the platform and its leading end is positioned by the restricting member, the operating section is operated to press down the arresting force applying member so that the workpiece tape is arrested. Thereafter, the pair of form cutters arranged with the arresting force applying member located intermediate therebetween obliquely enter the workpiece tape from above in conjunction with the operation of the arresting force applying member. Thereby, the workpiece tape is cut so as to form acute-angled ends and chamfered at the same time.

According to the invention, the workpiece tape can be cut into a specified acute-angular shape and, at the same time, chamfered at both side edges with the right and left (front and rear) pair of cutters only by placing a portion of a specified length on the platform, paid out from a long workpiece tape and moving the operating section downward. Accordingly, improved workability can be achieved and the workpiece tape can be processed to form ends of a specified shape at the same time. In addition, the invention has the advantage that setting of the workpiece tape during processing can be performed while the cutters are in their stopped state and therefore secure operation can be ensured.

In the invention, since the arresting force applying member is composed of an engagement rod that is vertically movable relative to the workpiece tape securely placed on the platform and an engagement needle attached to the leading end of the engagement rod such that it can pass through the center line of the workpiece tape so as to hold the workpiece tape, the workpiece tape can be arrested by the penetration of the engagement needle. Therefore, the workpiece tape can be stably held during the cutting and chamfering operation by the two cutters. Accordingly, the workpiece tape can be securely processed without trouble, using the form cutters.

The pair of cutters are downwardly inclined and supported, at their respective shanks, by brackets respectively which stand upright on the side positions of the platform, so that the cutters can be synchronously advanced and retracted relative to the workpiece tape. This enables rational operation in which the workpiece tape is cut so as to form desired acute-angled ends and chamfered at the same time, by linearly moving the pair of cutters within a narrow space with a simple mechanism and inserting the form cutting edges into the workpiece tape at a desired angle.

Further, the invention has, as the driving means, a pair of pivotable cams that are connected, by means of driving rods respectively, to a slider capable of vertically moving along a frame installed on the platform. Cutter operating pins attached to the cams are brought into engagement with cutter operation holes provided in the cutters, so that the cutters are actuated. This has the advantage that cutting operation can be performed without causing the displacement of the pair of cutters due to the actuation of the cams, after the workpiece tape is arrested by a single action exerted thereon.

BRIEF DESCRIPTION OF DRAWINGS

FIG. 3(*b*) is a sectional view of a cutter head section taken along line b-b of FIG. 3(*a*); and FIG. 3(*c*) is a rear view of a cutter head.

FIG. 4(*b*) is a plan view of a positioning stopper for the workpiece tape.

EXPLANATION OF REFERENCE NUMERALS

Figure 1:
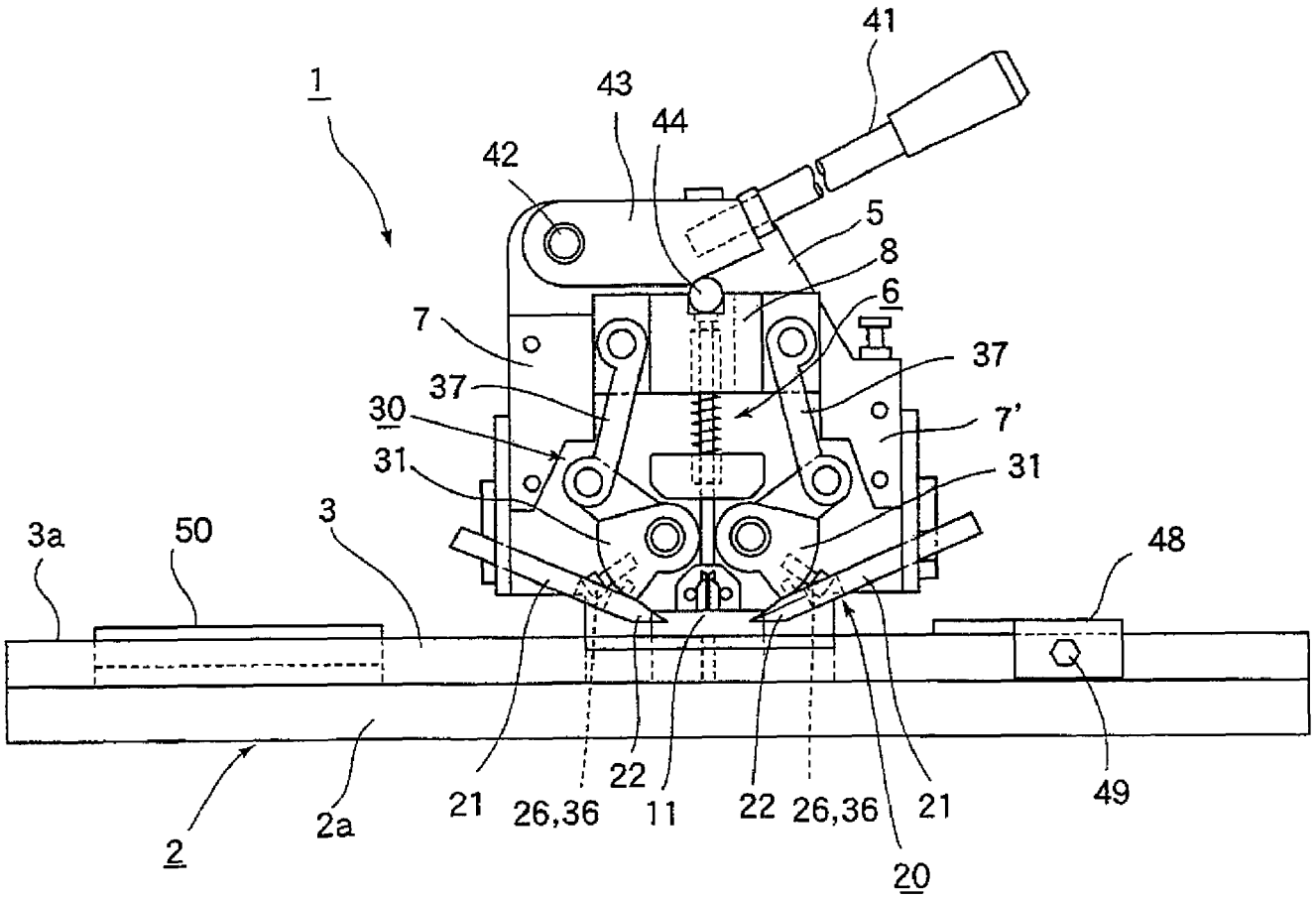
FIG. 1 is a front view of an apparatus for chamfering fold formation tape ends according to a first embodiment of the invention.

1: apparatus for chamfering fold formation tape ends
2: platform
3: guide plate
5: frame
6: arresting means
8: slider
10: engagement rod
11: engagement needle
13: coil spring
20: cutting means
21: cutter
22: cutter head
23: cutting edge
25: shank
26: cutter operation hole
27: bracket
30: driving means
31, 31': cam
33: operating arm
34: magnet piece
36: cutter operating pin
37: driving arm
41: control lever
43: base piece
48: positioning stopper
52: guide pin
54: hydraulic cylinder
60: workpiece tape

Best Mode For Carrying Out The Invention

Referring now to the accompanying drawings, an apparatus for chamfering fold formation tape ends will be described according to preferred embodiment of the invention.

Figure 2:
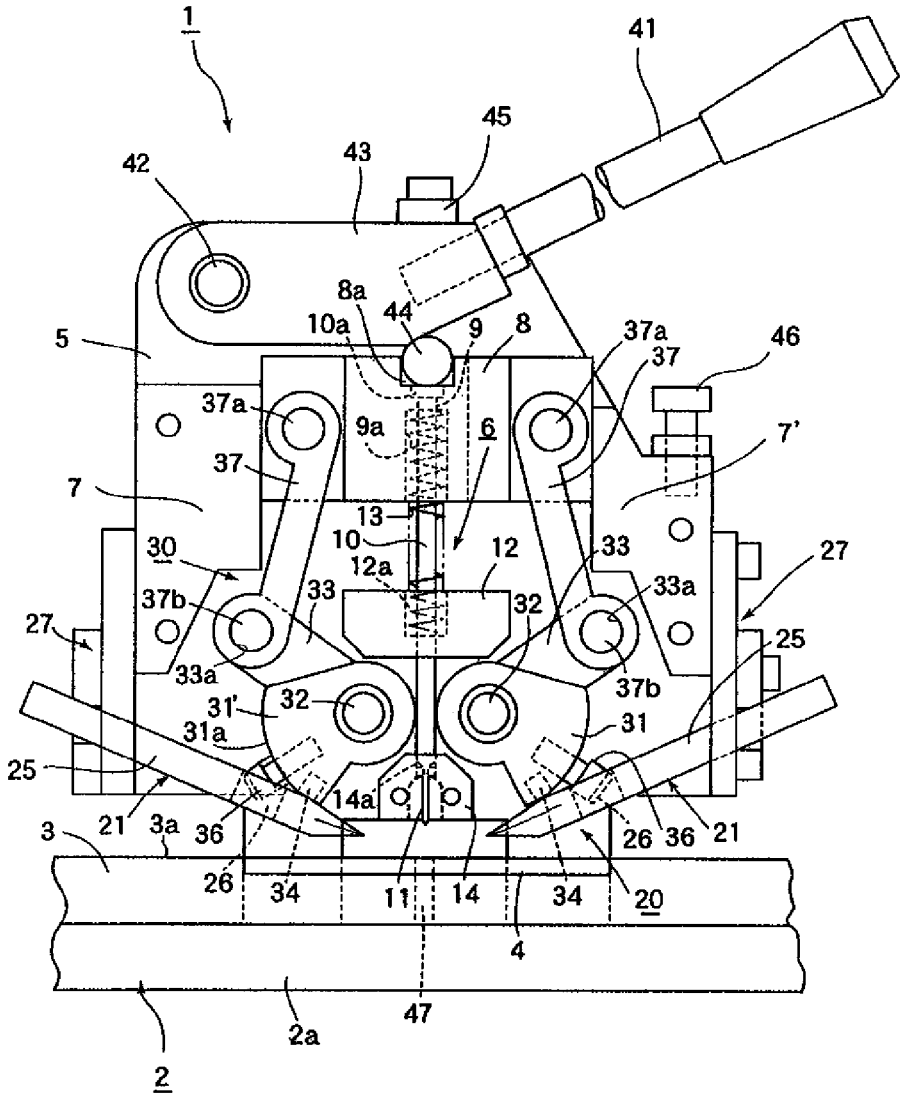
FIG. 2 is an enlarged detail view showing a relevant part.
Figure 3:
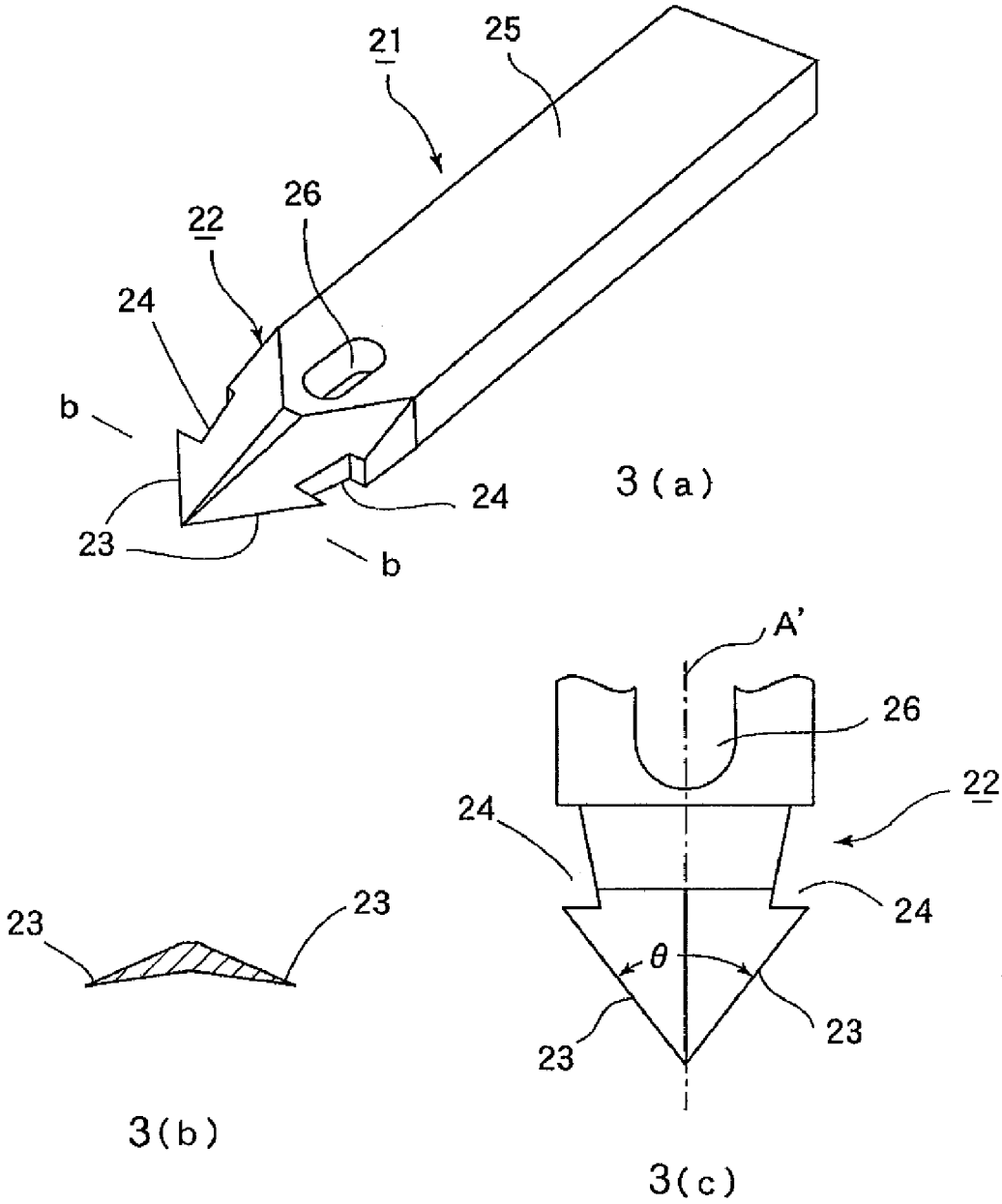
FIG. 3(*a*) is an overall perspective view of a cutter.
Figure 4:
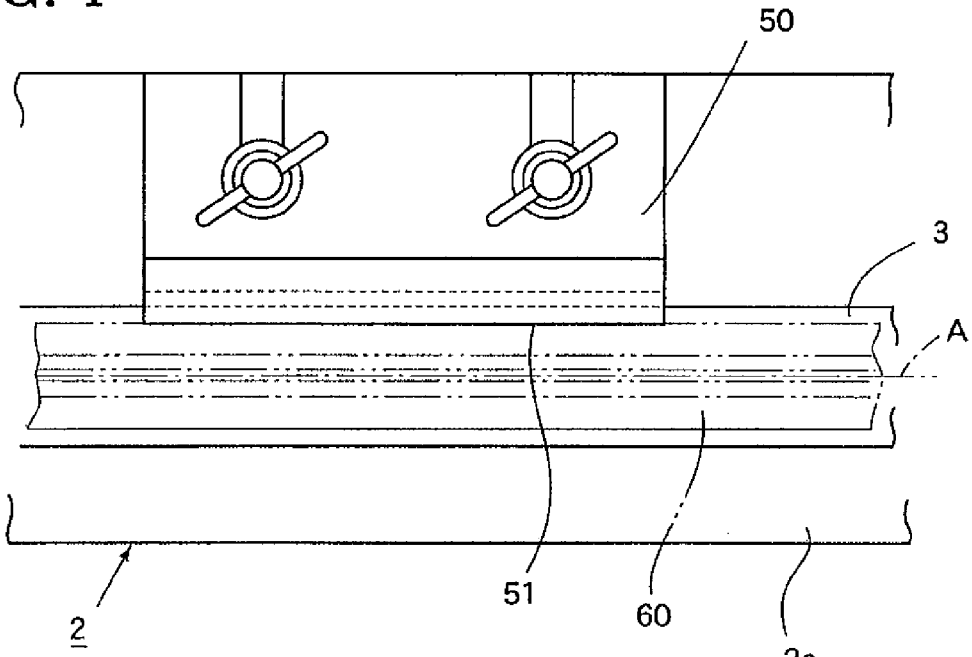
FIG. 4(*a*) is a plan view of a guide member for a workpiece tape.
Figure 4:
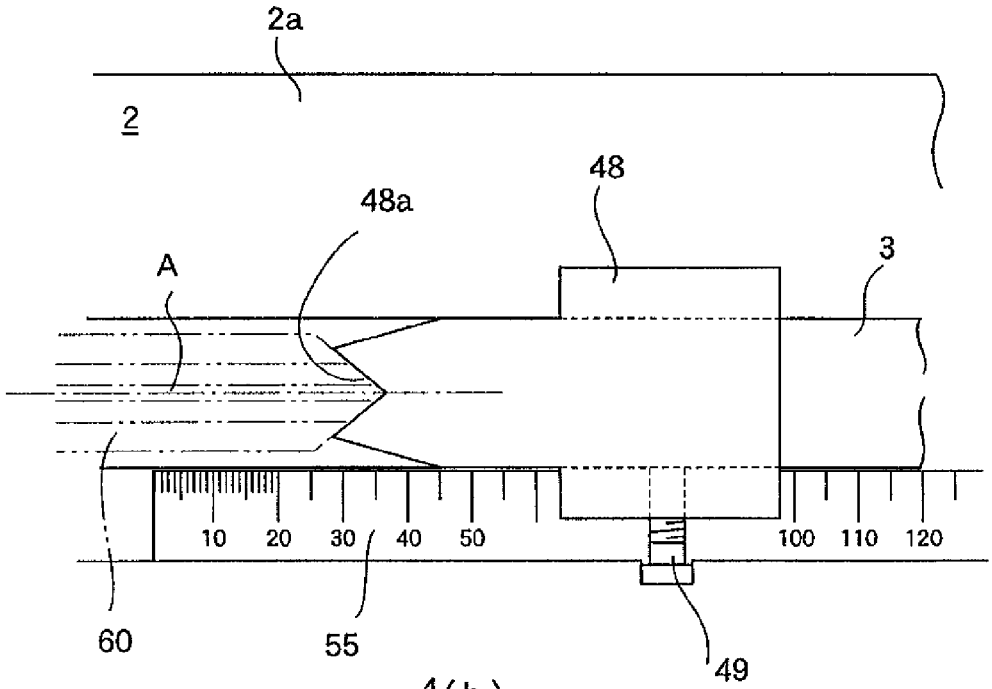
Figure 5:
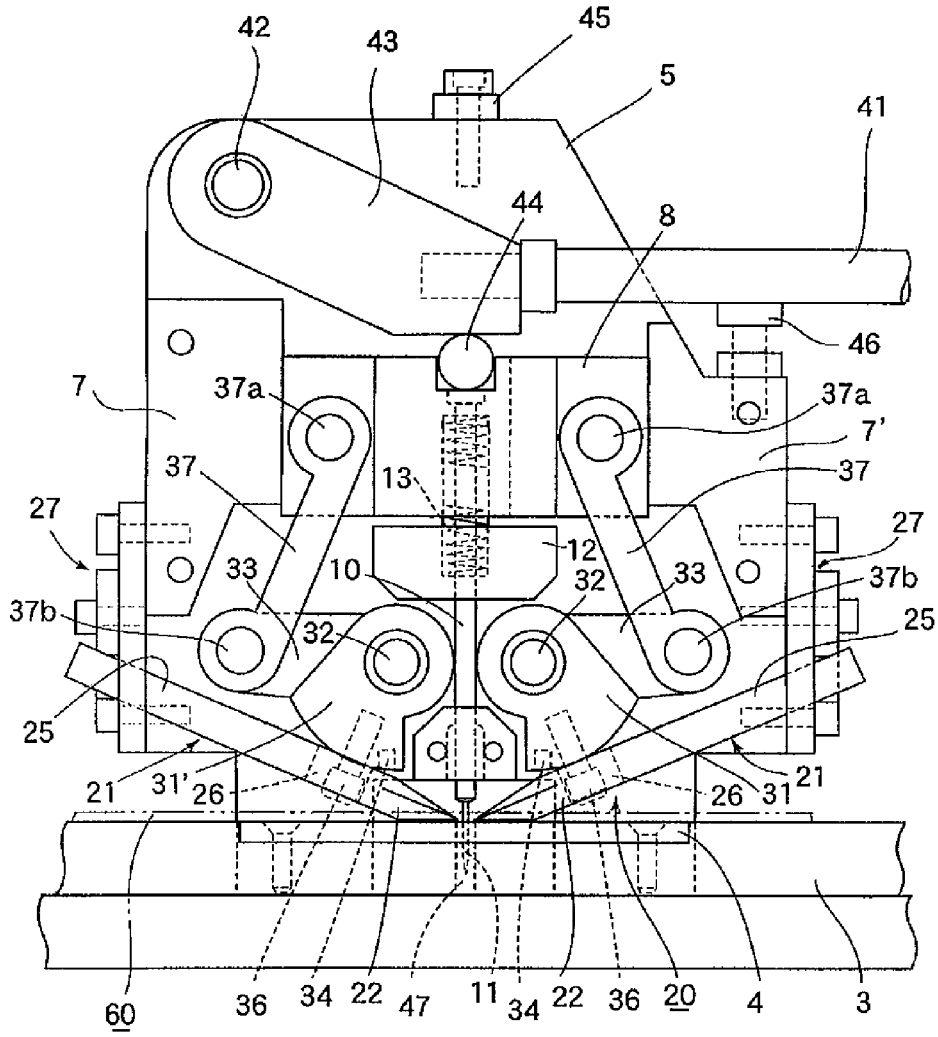
FIG. 5 is a view showing an embodiment of the operation of the apparatus for chamfering fold formation tape ends.
Figure 6:
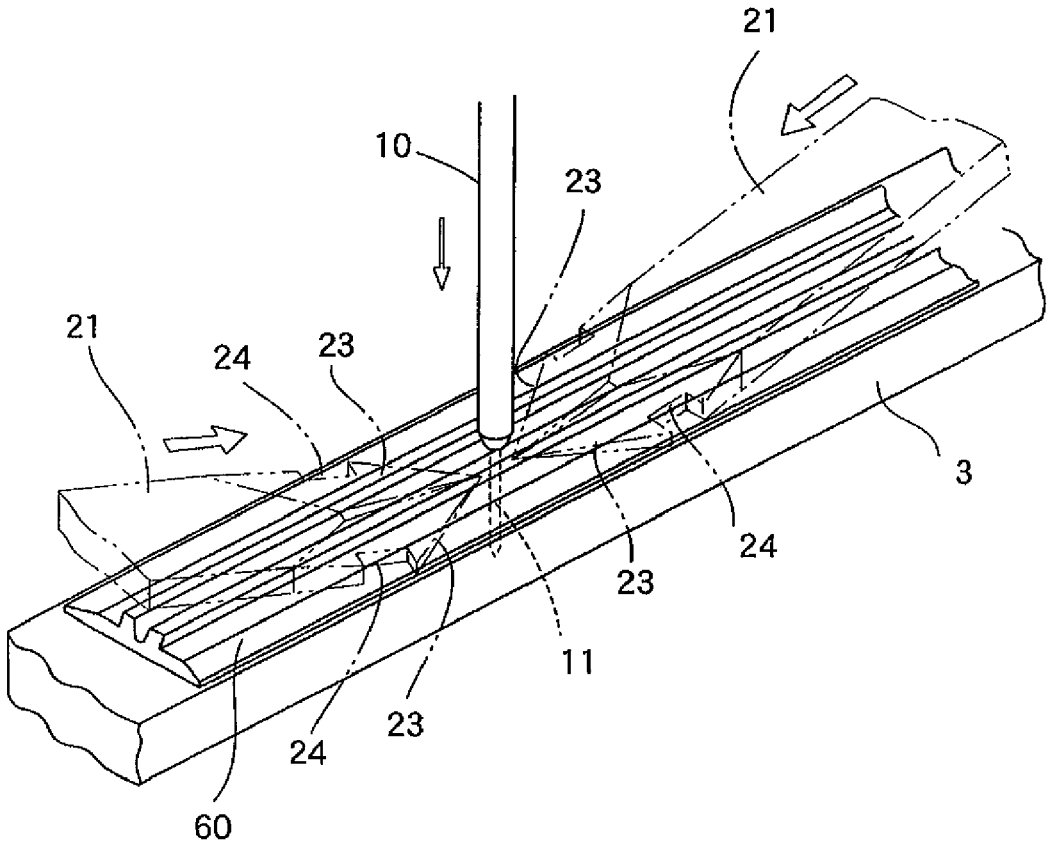
FIG. 6 is a perspective view of a relevant part, which shows a scene in which the cutters cut into the workpiece tape.

FIG. 1 is a front view of an apparatus for chamfering fold formation tape ends according to a first embodiment of the invention. FIG. 2 is an enlarged detail view showing a relevant part of the apparatus for chamfering fold formation tape ends. FIG. 3(*a*) is an overall perspective view of a cutter; FIG. 3(*b*) is a sectional view of a cutter head section taken along line b-b of FIG. 3(*a*); and FIG. 3(*c*) is a rear view of a cutter head. FIG. 4(*a*) is a plan view of a guide member for a workpiece tape; and FIG. 4(*b*) is a plan view of a positioning stopper for the workpiece tape. FIG. 5 is a view showing an embodiment of the operation of the apparatus for chamfering fold formation tape ends. FIG. 6 is a perspective view of a relevant part, which shows a scene in which the cutters cut into the workpiece tape.

The apparatus for chamfering fold formation tape ends 1 according to a first embodiment is composed of: a platform 2 for supporting a workpiece tape 60 placed thereon; a frame 5 installed on the platform 2 so as to stand upright; an arresting means 6 attached to a side face (front face) of the frame 5, for engagingly retaining the workpiece tape 60 placed on the platform 2 during the process of cutting; a cutting means 20 equipped with cutters 21; and a driving means 30 for driving the cutters 21 of the cutting means 20. In the first embodiment, the driving operation of the driving means 30 is allowed by the operator manually operating a control lever 41.

The platform 2 is composed of a base plate 2*a* consisting of an elongated flat plate having a proper width and specified length and a guide plate 3 having a specified height and mounted on the upper face of the base plate 2*a* so as to extend in a longitudinal direction of the base plate 2*a*, for guiding the workpiece tape 60 placed thereon. In the middle of the guide plate 3 with respect to the longitudinal direction, the frame 5 stands upright on the base plate 2*a*, extending along a side face of the guide plate 3. A backup plate 4, which is made of resin to protect the cutting edges 23 of the cutters 21 (described later), is detachably embedded in the upper face of the guide plate 3 and located in a region corresponding to the frame 5, such that the upper face of the backup plate 4 is flush with a guide face 3*a* (constituted by the upper face of the guide plate 3). On the platform 2, a workpiece tape guide member 50 is provided on the workpiece tape 60 feeding side (the left side in FIG. 1), being attached to a side of the guide plate 3. As illustrated in FIG. 4(*a*), the workpiece tape guide member 50 is provided with a guide rim 51 that is positioned on the upper face of the guide plate 3, for guiding the workpiece tape 60 while aligning a side of the workpiece tape 60. To guide workpiece tapes 60 having different widths, this guide rim 51 can be adjustably ejected and retracted within a region of a specified length such that the center line A of the workpiece tape 60 passes the center of a cutting position.

The frame 5 supports, at its front face on the side of the guide plate 3, the arresting means 6, the cutting means 20, the driving means 30 for driving the cutting means 20, and the control lever 41 serving as an operating section for operating these means.

The arresting means 6 is constituted by a slider 8 and an engagement rod (arresting force applying member) 10. Both sides of the slider 8 are vertically guided by guides 7, 7' provided in the central upper part of the frame 5. The engagement rod 10 is inserted into a rod insertion hole 9 from above and has an engagement needle 11 at the leading end thereof, the rod insertion hole 9 being provided in the slider 8 so as to vertically pass through its center. The slider 8 has an engagement hole located above the rod insertion hole 9. The head 10*a* of the engagement rod 10 is engaged with this engagement hole such that the engagement rod 10 does not fall off. The slider 8 also has a stepped hole 9*a* that extends upwardly from the lower face of the slider 8 and is concentric with the rod insertion hole 9, having a bore diameter larger than that of the rod insertion hole 9. A spring shoe member 12 is attached to the frame 5 at a position somewhat lower than the lower limit position of the slider 8. The spring shoe member 12 has, at its center, a stepped hole 12*a* that is concentric with the stepped hole 9*a*. A coil spring 13 for allowing an upward return of the slider 8 is inserted between the stepped hole 12*a* and the downwardly directed stepped hole 9*a* of the slider 8. The engagement rod 10 is inserted into the rod insertion hole 9 of the slider 8 with its engagement needle 11 directed downward, such that the shank of the engagement rod 10 is kept in an upright condition within an aperture circumferential face located between the rod insertion hole 9 of the slider 8 and an insertion hole 14*a* provided in an engagement rod retaining member 14 located just above the processing position for the workpiece tape 60, and such that while the slider 8 being pushed up by the coil spring 13, the leading end of the engagement needle 11 is located at a position slightly higher than the upper face of the workpiece tape 60 placed on the guide plate 3 on the platform 2.

The cutting means 20 is composed of a pair of cutters 21 that are opposed to each other with a specified spacing therebetween. The cutters 21 are arranged with their cutting edges 23 downwardly directed toward the center. As shown in FIGS. 3(*a*) to 3(*c*), the cutters 21 is composed of a cutter head 22 having a grains-shaped tip and a relatively-long flat shank 25 having a rectangular cross-section. Each cutter 21 is retractably supported at a position somewhat behind the cutter head 22 by means of a cam 31, (31') provided in the driving means 30 (described later). The rear end of the shank 25 of the cutter 21 is slidably held and supported by a bracket 27 attached to a side of the frame 5.

In each cutter 21, the cutting edges 23 of the cutter head 22 make the same acute angle θ as of the processed end of the workpiece tape 60 in plan (Although this angle is 77 degrees in a center symmetry configuration in the embodiment, it is not necessarily limited to 77 degrees). The cutters 21 have rake faces that extend from the center line A' to both sides respectively on the upper face, making a specified rake angle and a relief for forming a so-called draft angle on the rear face so as to upwardly extend from the cutting edges 23 to the center line A' (see FIG. 3(*b*)). The cutters 21 are form cutters designed to perform chamfering at the same time with cutting of the workpiece tape 60 with their cutting edges 23, when entering the workpiece tape 60 with their cutting edges 23 directed and inclined downward. Cut parts of desired size are formed at the rear ends of the cutting edges 23 so that excessive load is not imposed on the cutters during cutting. Positioned behind the cutter head 22 thus configured is an oval cutter operation hole 26 that vertically passes through the cutter. Preferably, at least the cutter head 22 of each cutter 21 is made from cutting steel.

The driving means 30 for drivingly operating the cutters 21 is constituted by the pair of cams 31 and driving rods 37. The cams 31 are rotatably supported at the sides, respectively, of the engagement rod 10 under the spring shoe member 12. The driving rods 37 allow the cams 31 to pivot in conjunction with the vertical movement of the slider 8.

The cams 31 are pivotally supported by support shafts 32 respectively at their centers. The support shafts 32 are supported on the frame 5 at their bases so as to project therefrom. About one fourth the outer periphery of each cam 31 is constituted by a cam operating face 31*a* that is a circular arc face having a desired radius and in contact with the upper face of the shank 25 of its associated cutter 21. At a position continuous with each cam operating face 31*a*, an operation arm 33 is formed in an integral fashion such that it projects away from the center line of the engagement rod 10 in a radial direction of the support shaft 32 when it is assembled. The portion of each cam 31, which is opposite to the cam operating face 31*a* and its associated operating arm 33, has such an outer shape that the portion does not come into contact with the engagement rod 10 and the coil spring shoe member 12.

The cams 31, 31' thus formed are bilaterally symmetric. In each cam operating face 31*a*, a magnet piece 34 having high absorption power is embedded in a peripheral face portion opposite to the side where its associated operation arm 33 is provided. At a position of each cam operating face 31*a* displaced a specified angle (70 degrees in this embodiment) from an axis line passing through the center of a coupling hole 33*a* formed in each operating arm 33, a cutter operating pin 36 is implanted so as to project in a radial direction of its associated support shaft 32. The head of each cutter operating pin 36 is engagingly inserted in the cutter operation hole 26 provided in the base of the cutter head 22 of its associated cutter 21 such that the cutter 21 can be moved forward and backward by pivotal movement of the cam 31.

An end of each driving rod 37 is coupled to the slider 8 of the arresting means 6 with a pin 37*a*, whereas the other end is coupled to the coupling hole 33*a* provided in the operating arm 33 end of its associated cam 31 with a pin 37*b*. In this way, the cams 31 pivot in conjunction with the arrestment of the workpiece tape 60 by the engagement needle 11 provided at the lower end of the engagement rod 10.

The proximal end of a base piece 43 of the control lever 41 is pivotally attached to the upper part of the frame 5 by a pivotal shaft 42 at a position near an end of the upper part. Attached to the leading end of the base piece 43 is the control lever 41. If the control lever 41 is pressed down, the base piece 43 imposes a press-down force on the slider 8 through a roller 44 that is fitted in a recess 8*a* provided in the central top part of the slider 8. The upper limit position of the control lever 41 is restricted by an upper limit stopper 45 attached to the top of the frame 5 whereas the lower limit position of the control lever 41 is restricted by a lower limit stopper 46 that is attached to the frame 5 so as to be positionally adjustable.

The guide plate 3 placed on the platform 2 is provided with a receiving through hole 47 that is located just under the engagement rod 10, for receiving the engagement needle 11. As shown in FIG. 4(*b*), a positioning stopper (regulating member) 48 for stopping the leading end of the workpiece tape 60 at the leading end of the guide plate 3 is provided on the upper face of the platform 2 so as to be movable along the guide plate 3. Attached to the upper face of the platform 2 is a scale 55 parallel to the guide plate 3. By moving the positioning stopper 48 in accordance with the scale marks of the scale 55, a cut length for the workpiece tape 60 can be set and the position of the positioning stopper 48 can be set. The positioning stopper 48 includes a receiving section 48*a* located at the leading end thereof, the receiving section being formed in the shape of a V-shaped recess to receive the acute-angled leading end of the workpiece tape 60. A fixing bolt 49 is attached to the front side face of the positioning stopper 48 and configured such that the positioning stopper 48 can be fixed at a specified position by pressing the bolt 49 against a side face of the guide plate 3.

In the apparatus for chamfering fold formation tape ends 1 having the above-described structure, the position of the positioning stopper 48 is firstly set in order that a fold formation tape portion to be cut, which is paid out from the long workpiece tape 60, has a specified length. The positional setting of the positioning stopper 48 is preliminarily carried out by sliding the positioning stopper 48 over the guide plate 3 in accordance with the scale marks of the scale 55 attached to the upper face of the platform 2. After setting, the positioning stopper 48 is fixed by tightening the bolt 49 attached to a side face thereof.

After a cutting size is thus set, the workpiece tape 60 is placed on the guide plate 3 such that its leading end is brought into contact with the receiving section 48*a* of the positioning stopper 48 and retained temporally. At that time, the leading end is fitted in the V-shaped recess of the receiving section 48*a*, in cases where the leading end of the workpiece tape 60 has already been processed so as to have an acute angle. When a new tape is used, a tape, whose leading end has been cut beforehand so as to have an acute angle, may be used.

After preparation for the processing is finished, the control lever 41 is manually pressed down. Then, the slider 8 is pressed by the base piece 43 of the control lever 41 through the roller 44 as illustrated in FIG. 5 so that the slider 8 downwardly moves along the guides 7, 7' against the energizing force of the coil spring 13 used for restoration. When the control lever 41 is shifted in a downward direction, the lower face of the base piece 43 comes into contact with the roller 44 to exert a press down force, the roller 44 being fit in the recess 8*a* defined in the central part of the top face of the slider 8. Even if the contact position changes owing to the pivotal displacement of the base piece 43, the roller 44 interposed rotates thereby transmitting the press down force to the slider 8 without fail. Therefore, the engagement rod 10 suspending from the center position of the slider 8 moves down together with the slider 8 so that the engagement needle 11 suspending from the leading end of the engagement rod 10 lowers into the receiving through hole 47, after piercing through the workpiece tape 60 placed on the guide plate 3. In this way, the workpiece tape 60, through which the engagement needle 11 pierces, is arrested on the guide plate 3.

The cutting means 20 is actuated slightly after the piercing arrestment of the engagement needle 11 attached to the leading end of the engagement rod 10. In the cutting means 20, the pair of cams 31, located at the upper right and left sides (i.e., the front and back positions relative to the longitudinal direction of the workpiece tape 60) of the arrestment position where the workpiece tape 60 is arrested by the engagement needle 11, are coupled to the slider 8 by the driving arms 37. Therefore, when the slider 8 lowers, the cam 31 (located at the right in FIG. 5) pivots clockwise about the associated one of the support shafts 32 whereas the other cam 31' (located at the left in FIG. 5) pivots counterclockwise about the other support shaft 32. Thereafter, the operating pins 36 implanted in the peripheral surfaces of the cams 31, 31' are pivotally displaced into engagement with their respective cutter operation holes 26, so that the cutters 21 advance toward the workpiece tape 60 at the same time. As a result, the cutting edges 23 of each cutter head 22 obliquely cut into the workpiece tape 60 from above so as to form acute-angled ends. After the cutting edges 23 of both cutter heads 22 reach the upper face of the guide plate 3, the workpiece tape 60 is cut into a shape corresponding to the shape of the cutting edges 23 of the cutter heads 22, while the side edges of the workpiece tape 60 being chamfered. This cutting operation is performed on both sides of the position where the workpiece tape 60 is arrested by the engagement needle 11.

After the workpiece tape 60 has been cut in this way, the press down force imposed on the slider 8 is released by raising the control lever 41 so that the slider 8 is pushed back to its initial position by the reserved compressive force of the coil spring 13 interposed between the spring shoe member 12 and the slider 8. Then, the slider 8 and the engagement rod 10 supported by the slider 8 are pulled up together so that the engagement needle 11 is also lifted up. Chips of the workpiece tape 60 which have been impaled by the needle 11 is removed by the lower face of the engagement rod retaining member 14 and the engagement needle 11 is retracted upward. Further, the driving rods 37 are pulled up concurrently with the retraction (rise) of the slider 8 and the operating arms 33 connected to the driving rods 37 are pulled, causing a reverse rotation of the cams 31, 31'. Then, the cutter heads 22 are withdrawn by the operating pins 36 attached to the cams 31, 31' and the cutters 21 return to their initial positions. These operations are performed at the same time so that the apparatus returns to a wait position. Accordingly, the processed fold formation tape can be easily taken out from the position under the cutters 21 and debris can be removed from the upper face of the guide plate 3.

In the above-described operation for cutting and chamfering the workpiece tape 60 by the cutters 21, the cutting edges 23 of the form cutters cut into the workpiece tape 60 in obliquely downward directions because cutting and chamfering are performed at the same time by the cutters 21 on both sides of the arrestment position where the workpiece tape 60 is piercingly arrested by the engagement needle 11. In spite of such a situation, the workpiece tape 60, which is arrested and fixed intermediate between these cutters, can be accurately cut into a specified size at two positions, without causing positional displacement, because the cutters simultaneously cut into the workpiece tape 60 from the right and left (when viewed from the front side). After completion of the cutting process, the next processing can be easily performed in the following way: The workpiece tape 60 is slid over the guide plate 3 to the next processing position after removing the processed tape; a cutting size is determined by fitting the leading end of the workpiece tape 60 into the recess of the receiving section 48*a* of the positioning stopper 48; and then, the control lever 41 is downwardly operated in the manner described earlier.

Since the workpiece tape 60 can be brought into fixing engagement with the engagement needle 11 by letting the control lever 41 down after setting the tape 60 on the guide plate 3 as described earlier and can be simultaneously cut at two positions by the pair of cutters 21 while being chamfered, significantly improved operational efficiency over prior art apparatuses can be achieved. In addition, the length of the finished tape can be easily set by moving the positional stopper 48 in accordance with the scale marks of the scale 55 and fixing it. Such operation can be quickly done without involving a lot of labor.

Further, thanks to the structure in which each cutter 21 is slidably supported at the rear end of the shank 25 held by the bracket 27 attached to the frame 5 and the leading end (cutter head 22) of each cutter 21 is absorptively retained by its associated strong magnet piece 34 embedded in the peripheral face of the cam 31 (31'), the operation can be performed with a little space between the cutters 21 and the setting position of the workpiece tape 60 and therefore removal of a processed tape and tape setting can be carried out without difficulty.

Figure 7:
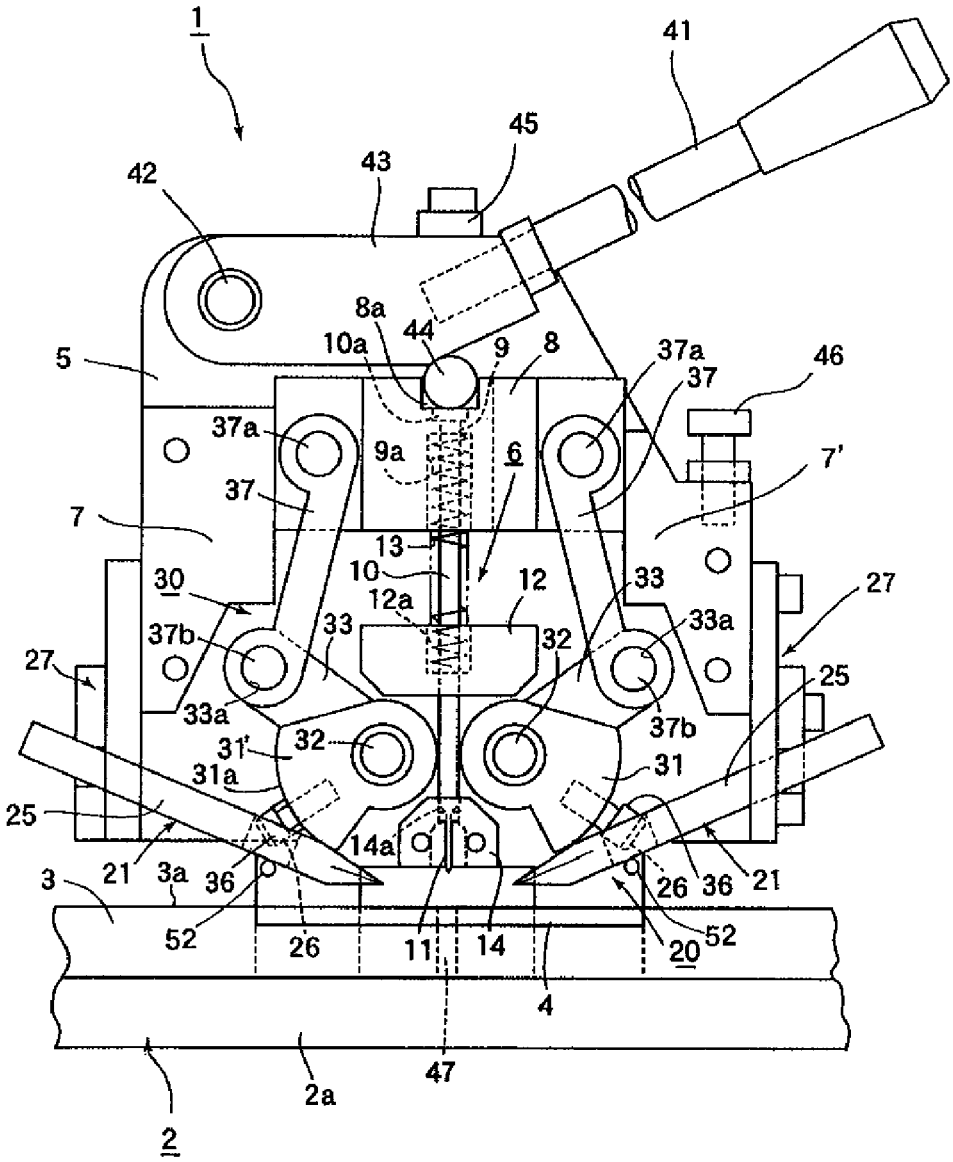
FIG. 7 is a front view of an apparatus for chamfering fold formation tape ends according to a second embodiment of the invention.

FIG. 7 is a front view of an apparatus for chamfering fold formation tape ends according to a second embodiment of the invention.

In the first embodiment, the magnet pieces 34 are embedded in the peripheral faces of the cams 31, 31' to thereby absorptively retain the leading ends of the cutters 21. In contrast with this, the second embodiment is designed to have guide pins 52 which are provided at the lower part of the frame 5 so as to project therefrom and by which the leading ends of the cutters 21 are supported. The use of the guide pins 52 in place of the magnet pieces 34 also makes it possible to support the leading ends of the cutters 21 during sliding of the cutters 21 and, in consequence, achieves the same operational effect as of the first embodiment. It is apparent that the magnet pieces 34 and the guide pins 52 can be used together.

Figure 8:
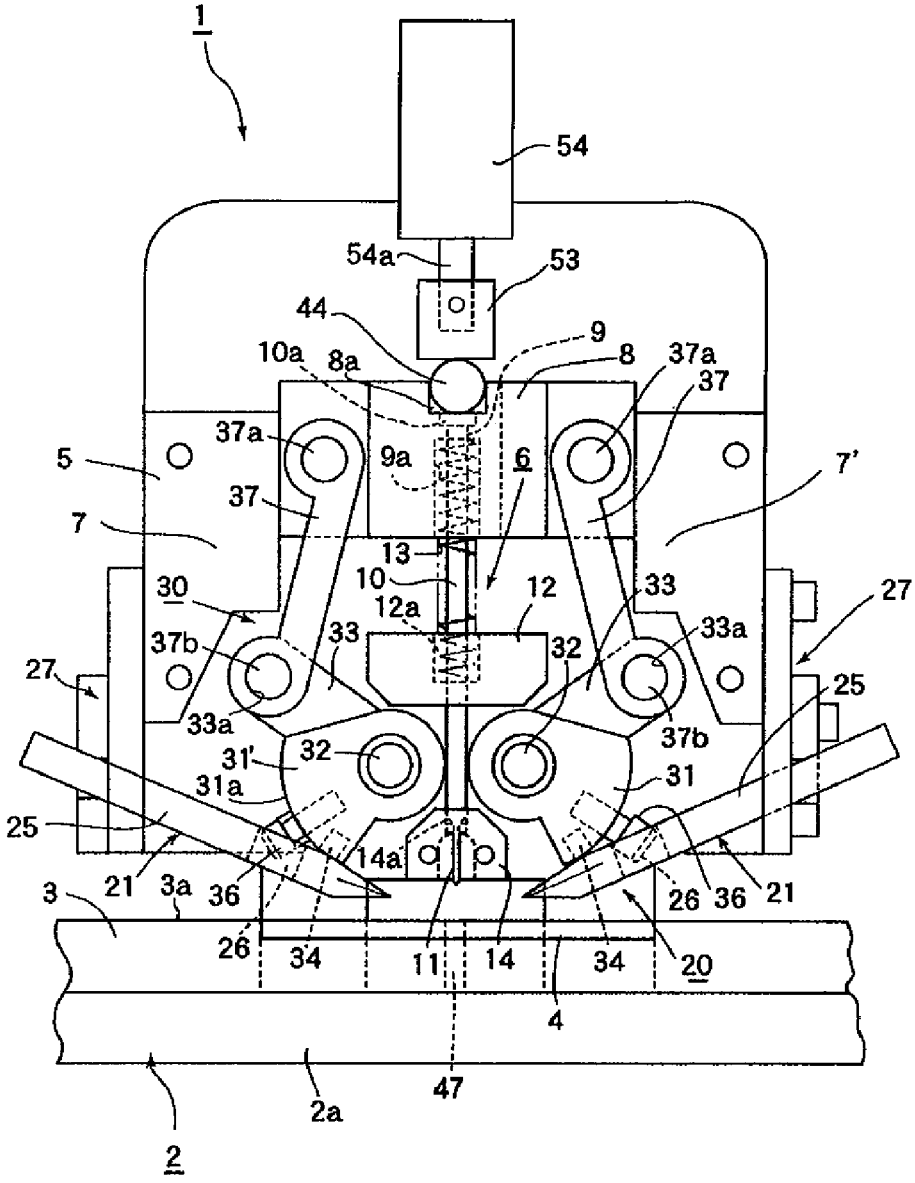
FIG. 8 is a front view of an apparatus for chamfering fold formation tape ends according to a third embodiment of the invention.
Figure 9:
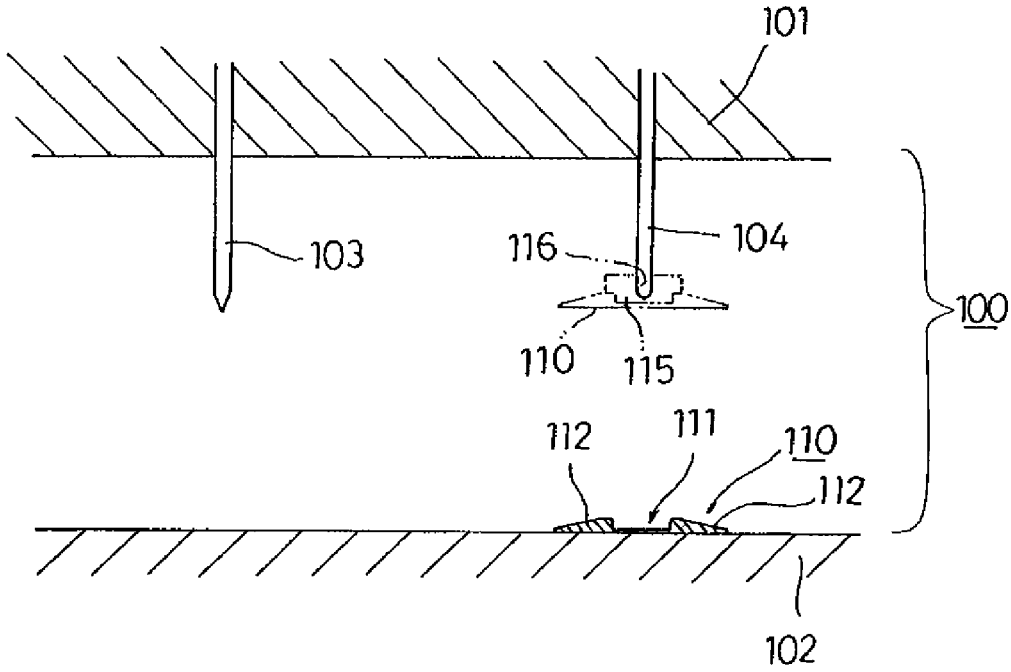
FIG. 9 is a view showing the relationship between the upper and lower dies of a punch die.
Figure 10:
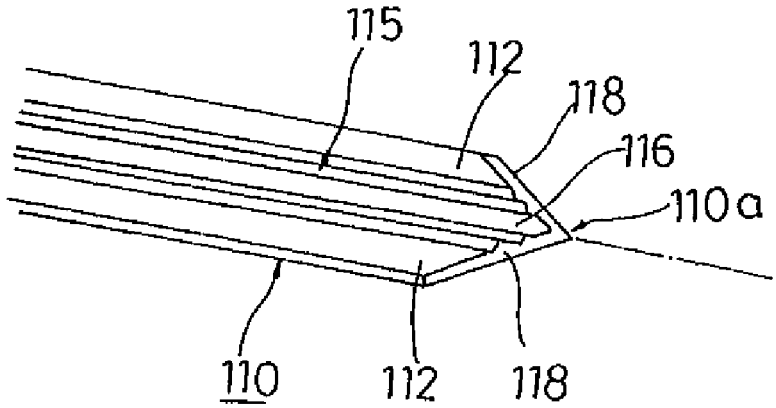
FIG. 10 is a view showing an end of a fold formation tape.
Figure 11:
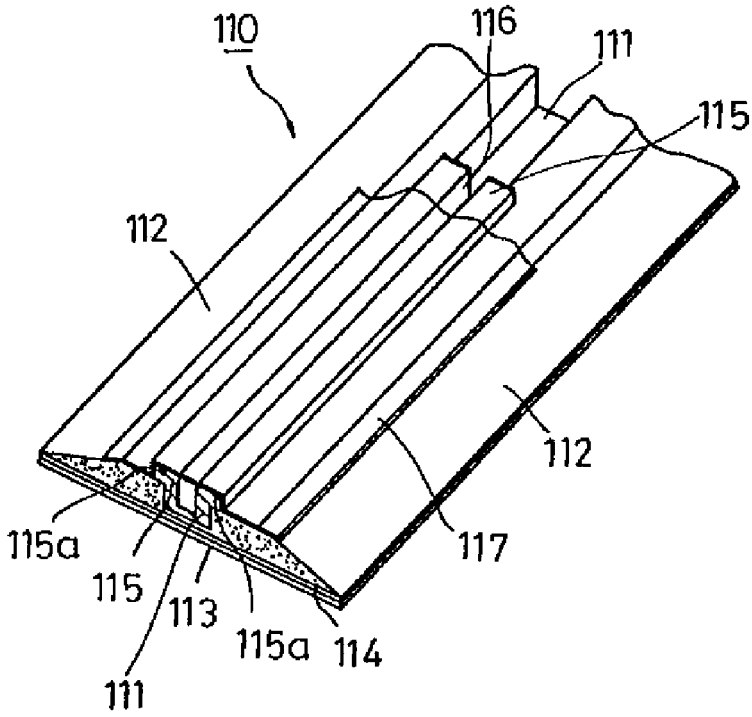
FIG. 11 is a perspective view showing a part of the fold formation tape.

FIG. 8 is a front view of an apparatus for chamfering fold formation tape ends according to a third embodiment of the invention.

While the slider 8 is pressed down by manual operation of the control lever 41 in the first and second embodiments, the third embodiment is designed to apply a press down force to the slider 8 through the roller 44 by use of a hydraulic cylinder (or pneumatic cylinder) 54 supported by the frame 5. Specifically, an adjustment jig 53 is attached to the leading end of the cylinder rod 54*a* of the hydraulic cylinder 54 and a press down force is applied by the lower face of the adjustment jig 53 while the cylinder rod 54*a* being expanded. Herein, the hydraulic cylinder 54 is put into operation by depressing an operating button (not shown).

The apparatus for chamfering fold formation tape ends according to the invention is not necessarily limited to the particular embodiments described herein. In one modification, an engagement piece may be used as the arresting force applying member of the arresting means in place of the engagement needle attached to the leading end of the engagement rod. This engagement piece is thin with respect to a direction intersecting the workpiece tape and jagged at its leading end. It is apparent that the configuration of the frame, the operating mechanism of the slider and the retaining structure of the cutters may be arbitrarily modified according to need and these modifications all fall within the scope of the invention.

The invention claimed is:

1. An apparatus for chamfering fold formation tape ends, the apparatus comprising:

a restricting member for restricting the position of one end of a workpiece tape on a platform;

a vertically-movable arresting force applying member for applying an arresting force onto the workpiece tape from above while one end of the workpiece tape being received by the restricting member;

a pair of form cutters for simultaneously cutting into the workpiece tape obliquely from above so as to form acute-angled ends and chamfering the workpiece tape, said pair of form cutters placed opposite to each other in an axial direction of the workpiece tape with the arresting force applying member positioned intermediate therebetween, and arranged such that the cutters are inclined downward toward their cutting edges so that the cutters can move downwardly on the platform, driving means for advancing and retracting the pair of cutters in relation to the workpiece tape in conjunction with a vertical movement of the arresting force applying member; and an operating section for operating the driving means;

wherein the cutting edge of each of the form cutters has a specified rake angle on the upper face that extends from the center to both sides respectively to form a specified rake angle, and by entering the workpiece tape with their cutting edges directed and inclined downward, processed ends of the workpiece tape are cut to have the same acute angle as the cutting edges in plan and chamfered at the same time.

2. The apparatus for chamfering fold formation tape ends according to claim 1, wherein the arresting force applying member comprises an engagement rod that is vertically movable relative to the workpiece tape fixedly placed on the platform and an engagement needle provided at the leading end of the engagement rod such that it can pass through a center line of the workpiece tape to hold the workpiece tape.

3. The apparatus for chamfering fold formation tape ends according to claim 1, wherein the pair of cutters are inclined downward and supported, at their respective shanks, by brackets standing upright at side positions of the platform respectively, such that the cutters can be synchronously advanced and retracted relative to the workpiece tape.

4. The apparatus for chamfering fold formation tape ends according to claim 1, wherein the operating section is a manually operable operating lever for applying a press down force to the slider.

5. The apparatus for chamfering fold formation tape ends according to claim 1, wherein the operating section is a hydraulic cylinder or pneumatic cylinder for applying a press down force to the slider.

6. The apparatus for chamfering fold formation tape ends according to claim 1, wherein the driving means includes a slider that is vertically movable along a frame mounted on the platform and a pair of pivotable cams connected to driving rods respectively, and wherein cutter operating pins attached to the cams are brought into engagement with cutter operation holes, respectively, provided in the cutters, thereby driving the cutters.

7. The apparatus for chamfering fold formation tape ends according to claim 6, wherein magnet pieces are embedded in the peripheral faces of the cams respectively to absorptively retain the leading ends of the cutters.

8. The apparatus for chamfering fold formation tape ends according to claim 6, wherein the frame has guide pins that are projectingly provided at positions facing the lower faces of the leading ends of the cams respectively to retain the leading ends of the cutters.

* * * * *